US009140207B2

(12) United States Patent
Tabuchi

(10) Patent No.: US 9,140,207 B2
(45) Date of Patent: Sep. 22, 2015

(54) CYLINDER HEAD

(71) Applicant: SUZUKI MOTOR CORPORATION, Shizuoka (JP)

(72) Inventor: Nobuo Tabuchi, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 14/097,486

(22) Filed: Dec. 5, 2013

(65) Prior Publication Data

US 2014/0202143 A1 Jul. 24, 2014

(30) Foreign Application Priority Data

Jan. 21, 2013 (JP) ..... 2013-008607

(51) Int. Cl.
*F01N 1/00* (2006.01)
*F02F 1/24* (2006.01)
*F02F 1/36* (2006.01)

(52) U.S. Cl.
CPC .. *F02F 1/243* (2013.01); *F02F 1/36* (2013.01)

(58) Field of Classification Search
USPC ..... 60/272, 298, 320, 321, 323; 123/41.72, 123/41.79, 41.82 A, 41.82 R, 41.84
See application file for complete search history.

(56) References Cited

U.S. PATENT DOCUMENTS

| | | | | |
|---|---|---|---|---|
| 8,146,543 | B2 * | 4/2012 | Kuhlbach et al. | 123/41.82 R |
| 8,291,699 | B2 * | 10/2012 | Payri Gonzalez et al. | 60/323 |
| 8,474,251 | B2 * | 7/2013 | Beyer et al. | 60/321 |
| 8,714,128 | B2 * | 5/2014 | Galeazzi et al. | 123/193.5 |
| 8,904,773 | B2 * | 12/2014 | Maruyama et al. | 60/321 |
| 2010/0251704 | A1 * | 10/2010 | Asame et al. | 60/323 |

FOREIGN PATENT DOCUMENTS

JP 2010-209749 A 9/2010

* cited by examiner

*Primary Examiner* — Binh Q Tran
(74) *Attorney, Agent, or Firm* — Rothwell, Figg, Ernst & Manbeck, P.C.

(57) ABSTRACT

A cylinder head capable of improving a productivity of a cylinder head having an exhaust collecting portion and improving a cooling efficiency of the exhaust collecting portion is disclosed. An exhaust collecting portion 9 is surrounded by an upper side flow passage portion 15, a lower side flow passage portion 16 and extended flow passage portions 17 into which coolant flows through a coolant communication passage 26 from a lower portion side water jacket 12 that is opening in a cylinder block 2. The upper side flow passage portion 15 and the extended flow passage portions 17 are formed at a time of the molding along with an upper portion side water jacket 11 by a core for upper portion side water jacket 18, while the lower side flow passage portion 16 is formed by the drilling after the molding.

6 Claims, 7 Drawing Sheets

CYLINDER HEAD

CROSS-REFERENCE TO RELATED APPLICATION

The present application claims the benefit of priority to Japanese Patent Application No. 2013-8607, filed on Jan. 21, 2013, the entire content of which is incorporated herein by reference.

FIELD OF THE INVENTION

The present invention relates to a cylinder head of an engine to be used in a motor vehicle and the like, which is suitable for a cylinder head that normally constitutes an engine main body by being attached to an upper end face of a cylinder block.

BACKGROUND OF THE INVENTION

In a multi-cylinder engine that has a plurality of cylinders in one cylinder block, a plurality of combustion chambers are formed on a cylinder block joint surface of the cylinder head along cylinder banks. To each cylinder, an exhaust port for ejecting exhaust gas inside the combustion chamber is connected. There has been a proposition to collect these exhaust ports inside the cylinder head to form an exhaust collecting portion, and make that exhaust collecting portion integral to the cylinder head. In Japanese Patent Application Publication No. 2010-209749, a first water jacket for cooling the surrounding of the combustion chambers is provided. Also, the exhaust collecting portion is integrally formed inside the cylinder head. An upper side flow passage portion is formed on an engine upper side of this exhaust collecting portion, and a lower side flow passage portion is formed on an engine lower side of this exhaust collecting portion. The coolant flows into these upper side flow passage portion and lower side flow passage portion. A communication flow passage portion for communicating between the upper side flow passage portion and the lower side flow passage portion is arranged on a side of the exhaust collecting portion. The upper side flow passage portion, the lower side flow passage portion and the communication flow passage portion constitute a second water jacket for cooling the exhaust collecting portion, separately from the first water jacket. The cooling performance of the exhaust collecting portion is improved by this second water jacket.

In the cylinder head as described in Japanese Patent Application Publication No. 2010-209749, the communication flow passage portion for communicating between the upper side flow passage portion and the lower side flow passage portion is arranged in a position closer to an outer side surface of the cylinder head than the exhaust ports. For this reason, at a time of the molding, it is necessary to set a core for first water jacket and a core for exhaust ports in a mold, and then set a core for second water jacket in the mold after that. Consequently, time and effort are required for the set up of the mold by setting a plurality of cores in the mold at a time of the molding, so that the yield and the productivity of the cylinder head is lowered. Also, when the upper side flow passage portion, the lower side flow passage portion and the communication flow passage portion are to be formed by setting a plurality of cores in the mold in this way, the core for first water jacket and the core for second water jacket are going to be placed along the arrangement direction of the cylinders. For this reason, the upper side flow passage portion and the lower side flow passage portion that are formed by the core for second water jacket are going to be divided in the arrangement direction of the cylinders. Also, the communication flow passage portion can be formed only on an outer side surface side of the cylinder head on a side of the exhaust ports, rather than on a side of the exhaust collecting portion. In other words, it is difficult to form the upper side flow passage portion, the lower side flow passage portion and the communication flow passage portion in such a way as to substantially surround the entire surrounding of the exhaust collecting portion, so that there is a room for improving the cooling performance of the exhaust collecting portion in particular.

SUMMARY OF THE INVENTION

The present invention has been made in view of the problems as noted above, and has an object to provide a cylinder head capable of improving a productivity of a cylinder head having an exhaust collecting portion and improving a cooling efficiency of the exhaust collecting portion.

In order to solve the above noted problems, the embodiment of the invention is a cylinder head for constituting an engine main body by being attached to the upper end face of the cylinder block, comprising: a plurality of combustion chambers provided on a joint surface to be joined with an upper end face of a cylinder block, along an arrangement direction of a plurality of cylinders formed in the cylinder block; a plurality of exhaust ports respectively connected to the plurality of combustion chambers, for ejecting exhaust gas inside each combustion chamber; an exhaust collecting portion for collecting the plurality of exhaust ports; an upper side flow passage portion into which coolant flows, which is formed on an engine upper side of the exhaust collecting portion by molding; a lower side flow passage portion into which the coolant flows, which is formed on an engine lower side of the exhaust collecting portion by cutting; and a pair of extended flow passage portions formed at both side portions of the exhaust collecting portion by the molding, for connecting the upper side flow passage portion and the lower side flow passage portion and surrounding the exhaust collecting portion together with the upper side flow passage portion and the lower side flow passage portion.

Also, the upper side flow passage portion and the extended flow passage portions are integrally molded by a core for upper portion side water jacket having an upper side flow passage portion formation portion and extended flow passage portion formation portions.

Also, the cylinder head further comprises: a lower portion side water jacket, into which the coolant flows from the cylinder block, which is extending along the arrangement direction of the cylinders and formed on the joint surface with respect to the cylinder block; and a coolant communication passage for communicating between the lower portion side water jacket and the lower side flow passage portion, which is formed by the cutting.

According to the embodiment of the invention, the upper side flow passage portion and the extended flow passage portions into which coolant flows are formed by the molding, and the lower side flow passage portion into which the coolant flows is formed by the cutting, so that there is no need to divide the upper side flow passage portion and the lower side flow passage portion in the arrangement direction of the cylinders. As a result, it is possible to substantially surround the entire surrounding of the exhaust collecting portion by the upper side flow passage portion, the extended flow passage portions and the lower side flow passage portion, so that it is possible to improve the cooling efficiency of the exhaust collecting portion. Also, because the lower side flow passage portion is formed by the cutting, a core for forming the lower side flow passage portion by the molding becomes unnecessary. For this reason, at a time of forming the cylinder head by the molding, it becomes possible to set a core for forming the upper side flow passage portion and the extended flow passage portions and a core for forming the exhaust collecting portion in a mold by superposing one on top of the other, without being obstructed by the lower side flow passage portion. Consequently, it is possible to prevent the breaking or the damaging of the cores, while the productivity is improved as the time and effort required for the incorporation of the cores are reduced.

Also, the upper side flow passage portion and the extended flow passage portions are integrally formed at a time of the molding by the core for upper portion side water jacket. In this way, it is possible to form the upper portion side water jacket, the upper side flow passage portion, the extended flow passage portions, the exhaust ports and the exhaust collecting portion at a time of the molding, by simply arranging the core for exhaust ports including the exhaust collecting portion and the core for upper portion side water jacket in a manner of superposition in an engine up and down direction, so that the productivity of the cylinder head is improved.

Also, a lower portion side water jacket, into which the coolant flows from the cylinder block, and which is extending along the arrangement direction of the cylinders, is formed on the joint surface with respect to the cylinder block, and a coolant communication passage for communicating between the lower portion side water jacket and the lower side flow passage portion is formed by the cutting. Consequently, the coolant of a relatively low temperature in the lower portion side water jacket is supplied to the lower side flow passage portion from the coolant communication passage, and further supplied to the upper side flow passage portion from the extended flow passage portions. For this reason, in the surrounding of the exhaust collecting portion, the coolant of a low temperature flows without stagnation sequentially from the lower side flow passage portion to the extended flow passage portions and to the upper side flow passage portion, so that it is possible to improve the cooling efficiency of the exhaust collecting portion even further. Also, because the coolant communication passage is formed by the cutting, a core for forming the coolant communication passage by the molding becomes unnecessary. For this reason, at a time of superposing the core for upper portion side water jacket and the core for exhaust ports in the engine up and down direction, it will not be obstructed by a core for coolant communication passage, so that the productivity of the cylinder head is improved as much as that.

DETAILED DESCRIPTION OF THE INVENTION

Figure 1:
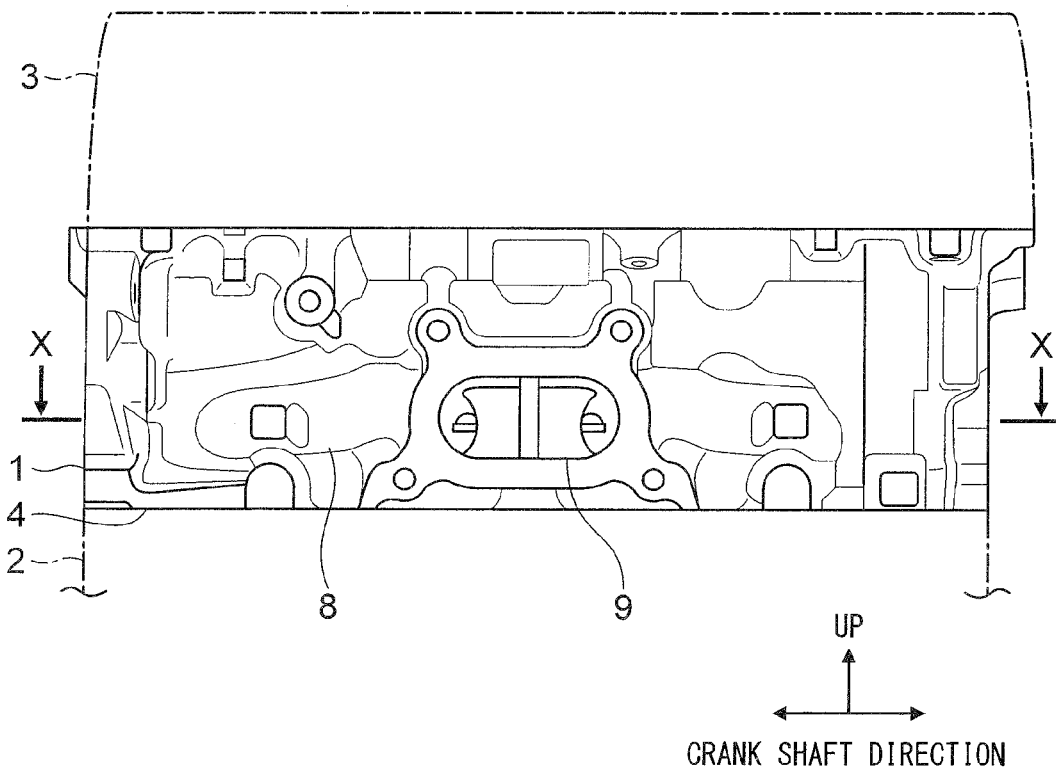
FIG. 1 is a front view showing one embodiment of a cylinder head of the present invention.
Figure 2:
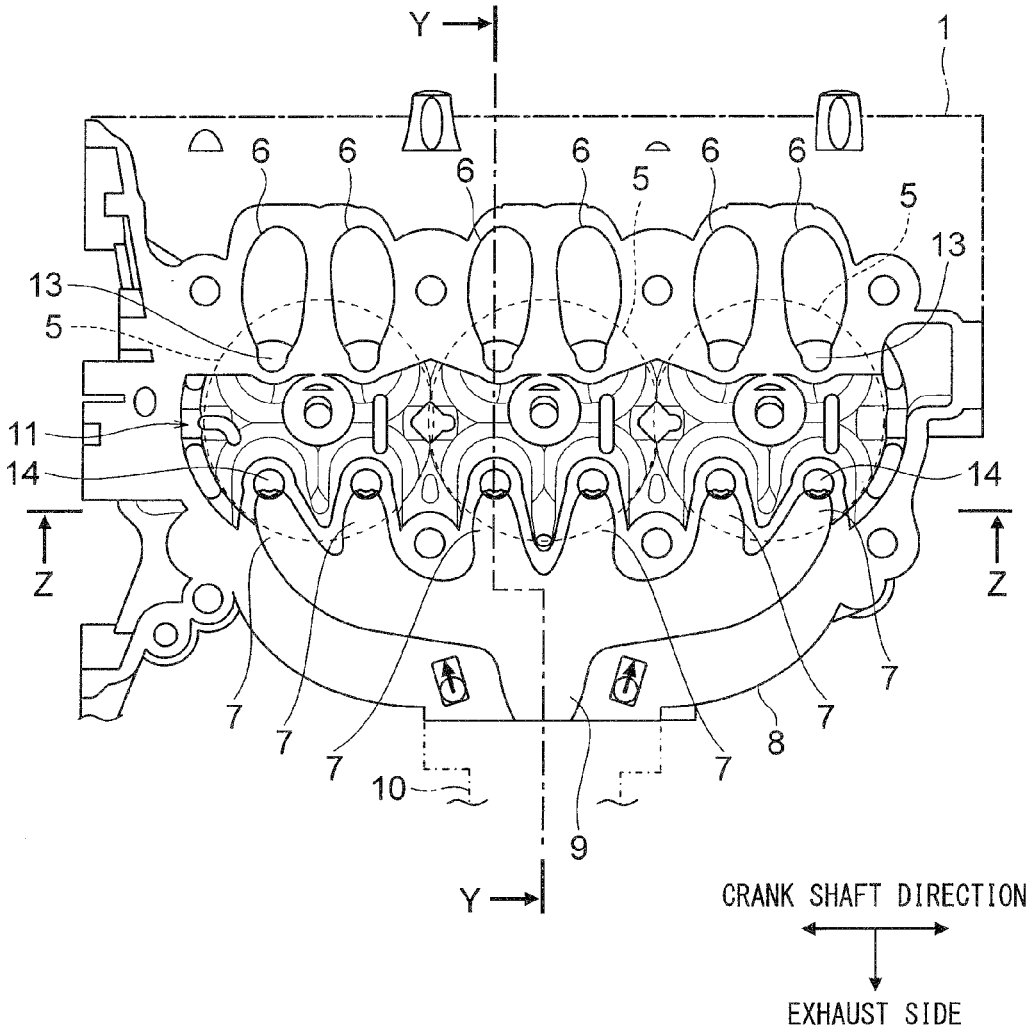
FIG. 2 is an X-X cross sectional view of FIG. 1.
Figure 3:
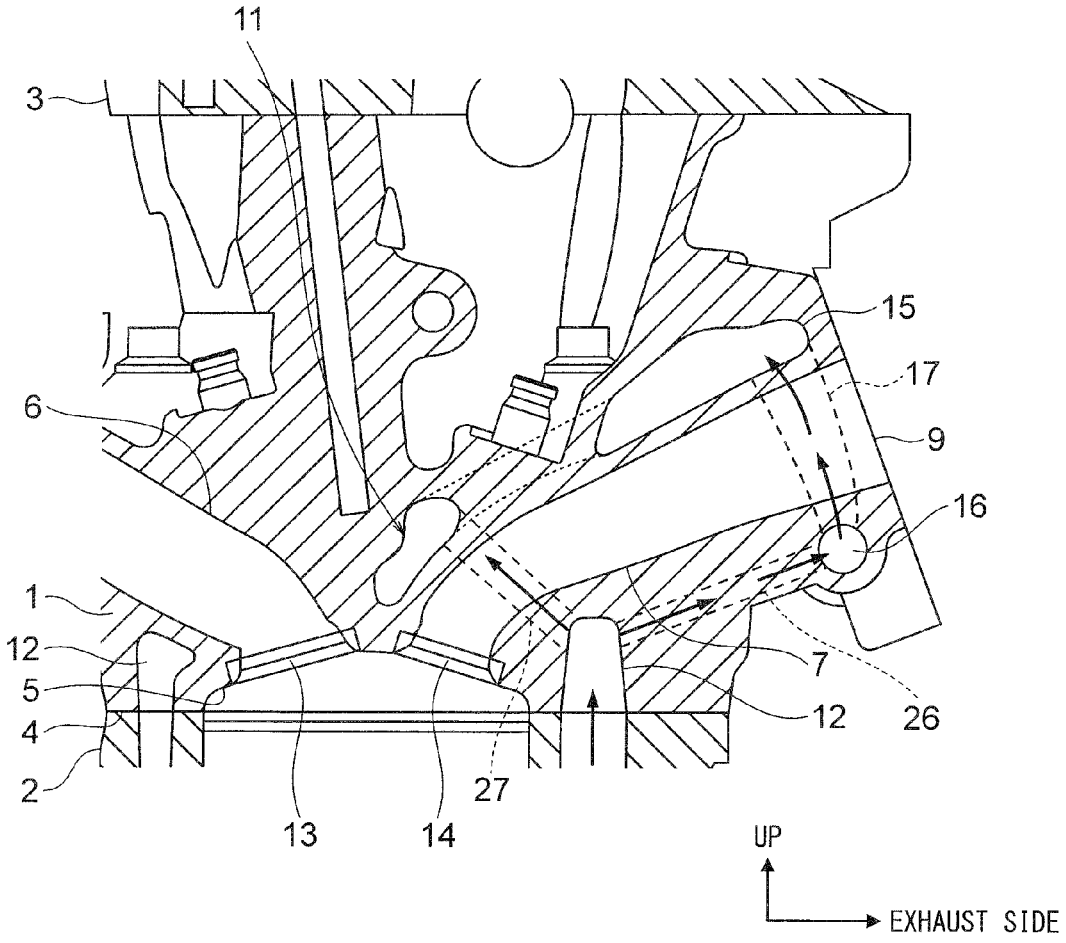
FIG. 3 is a Y-Y cross sectional view of FIG. 2.
Figure 4:
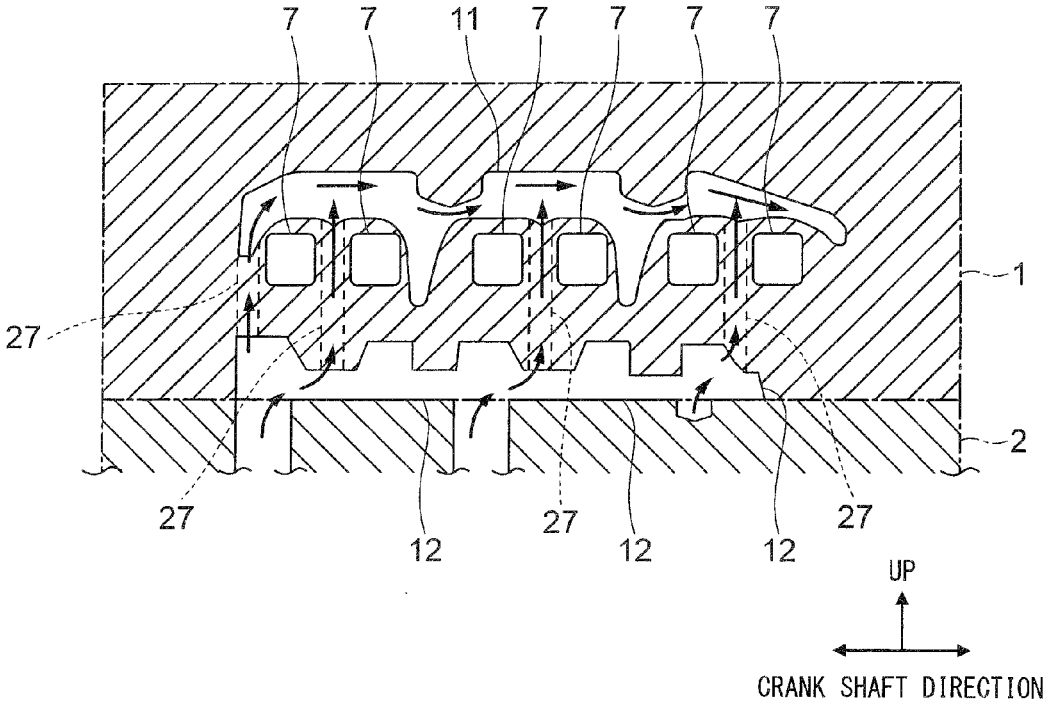
FIG. 4 is a Z-Z cross sectional view of FIG. 2.

Next, the cylinder head according to an embodiment of the present invention will be described with references to the drawings. FIG. 1 is a front view of the cylinder head of the present embodiment, FIG. 2 is an X-X cross sectional view of FIG. 1, FIG. 3 is a Y-Y cross sectional view of FIG. 2, and FIG. 4 is a Z-Z cross sectional view of FIG. 2. The cylinder head 1 of the present embodiment is attached to an upper end face of a cylinder block 2. The cylinder head 1 constitutes an engine main body for a motor vehicle by being attached to the upper end face of the cylinder block 2. On an upper end face of the cylinder head 1, a cylinder head cover 3 is attached. In the cylinder block 2, a plurality of cylinders are provided in one bank. On the cylinder head 1, a joint surface 4 to be joined with the cylinder block 2 is formed. On the joint surface 4, a plurality of combustion chambers 5 are formed along an arrangement direction of cylinders. In the present embodiment, along the arrangement direction of three cylinders, the combustion chambers 5 are respectively formed on top of each cylinder.

In each cylinder, a piston is accommodated to be movable in an up and down direction. These pistons are respectively linked with a crank shaft by connecting rods. The crank shaft is arranged along the arrangement direction of the combustion chambers 5. The crank shaft is arranged parallel to the arrangement direction of the combustion chambers 5 along the arrangement direction of the cylinders. The engine main body is mounted on the motor vehicle in various orientations. In general, the cylinder head 1 is mounted on top of the cylinder block 2, so that an upper side of the cylinder head 1 is defined as an engine upper side, and the cylinder block 2 side of the cylinder head 1 is defined as an engine lower side.

To the plurality of combustion chambers 5, air intake ports 6 and exhaust ports 7 are connected. The air intake port 6 respectively intakes fuel air mixture into each combustion chamber 5 and the exhaust port 7 respectively ejects exhaust gas from each combustion chamber 5. In the present embodiment, respectively two of the air intake ports 6 and the exhaust ports 7 are connected to each combustion chamber 5. On an end portion at the combustion chamber 5 side of the air intake port 6, an air intake inlet 13 is formed. On the combustion chamber 5 side of the exhaust port 7, an exhaust outlet 14 is formed. The cylinder head 1 of the present embodiment is integrated with an exhaust manifold 8. The plurality of exhaust ports 7 are collected to one exhaust collecting portion 9 inside the cylinder head 1. On a downstream side of the exhaust collecting portion 9, an exhaust pipe 10 is connected. To the exhaust pipe 10, a catalyst converter and the like that is not shown in the figure is connected.

An upper portion side water jacket 11 is formed on the engine upper side of the combustion chambers 5 and the exhaust ports 7. The coolant will flow into the upper portion side water jacket 11. A lower portion side water jacket 12 is formed on the engine lower side of the air intake ports 6 and the exhaust ports 7. The coolant will flow into the lower portion side water jacket 12. Note that, in FIG. 3, the lower portion side water jacket 12 is segmented for each combustion chamber 5, but the actual lower portion side water jackets 12 are mutually linked at a center side of the combustion chambers 5.

In the present embodiment, in addition to the upper portion side water jacket 11 and the lower portion side water jacket 12 mentioned above, the surrounding of the exhaust collecting portion 9 is also cooled by the coolant. More specifically, as shown in FIG. 3, an upper side flow passage portion 15 is formed on the engine upper side of the exhaust collecting portion 9, and a lower side flow passage portion 16 is formed on the engine lower side of the exhaust collecting portion 9, and extended flow passage portions 17 for connecting the upper side flow passage portion 15 and the lower side flow passage portion 16 are formed on both left and right sides (in the cylinder bank direction=the crank shaft direction) of the exhaust collecting portion 9. Among them, the upper side flow passage portion 15 is connected to the upper portion side water jacket 11, and the extended flow passage portions 17 are connected to the upper side flow passage portion 15. The lower side flow passage portion 16 is formed by the cutting such that it connects the extended flow passage portions 17 on left and right.

Figure 5:
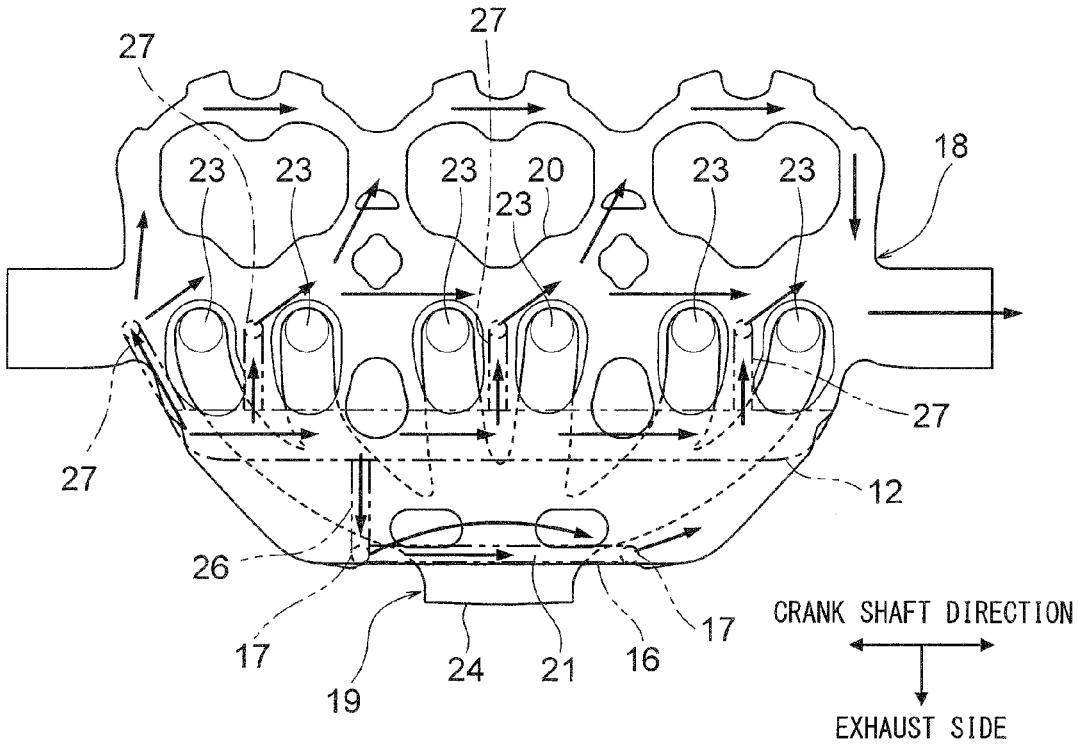
FIG. 5 is a plan view of a core to be used in the molding of the cylinder head of FIG. 1.
Figure 6:
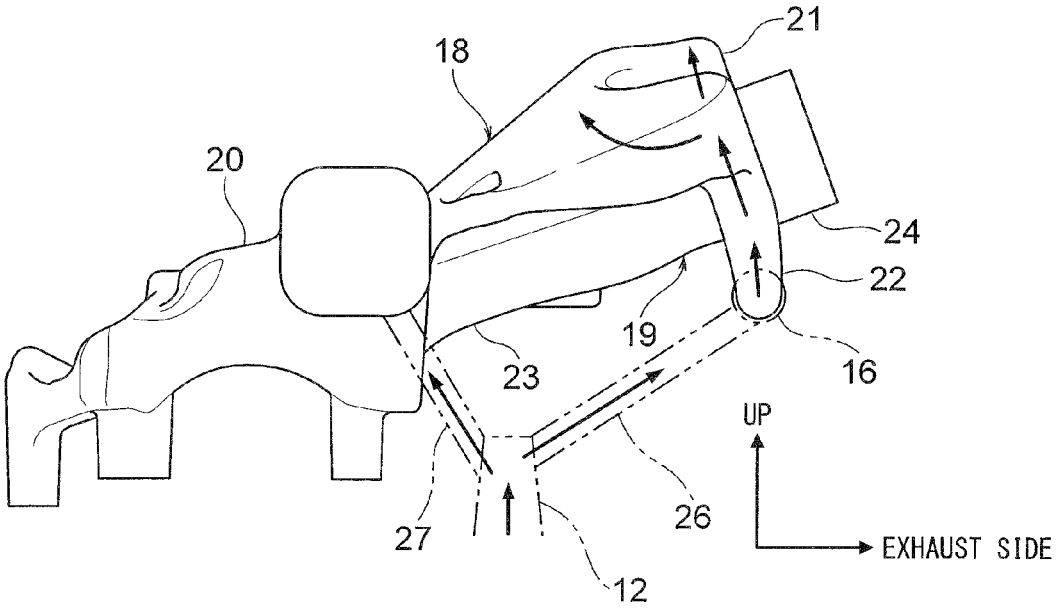
FIG. 6 is a left side view of the core of FIG. 5.
Figure 7:
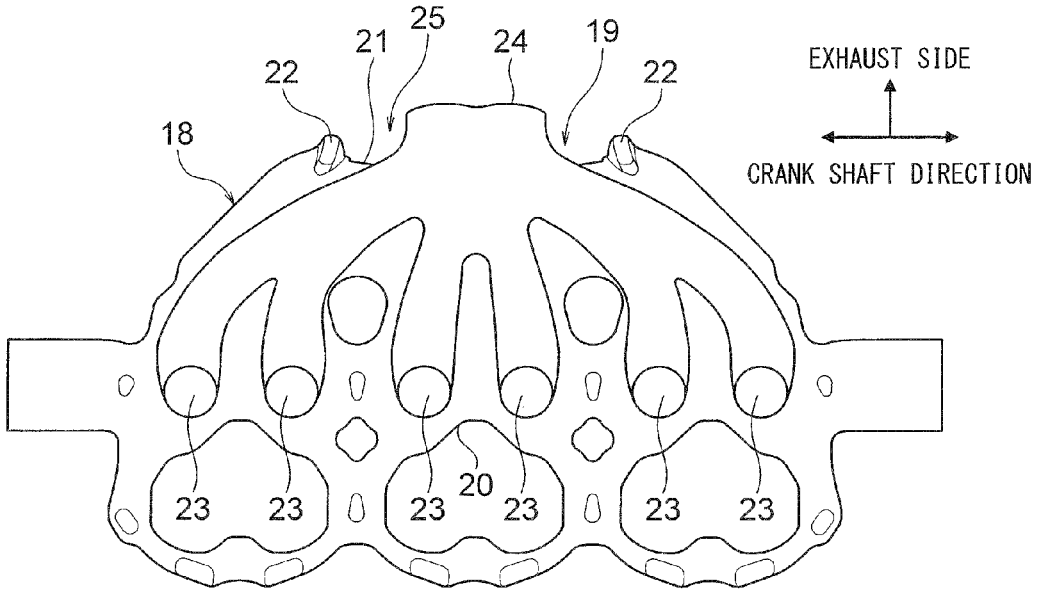
FIG. 7 is a bottom view of the core of FIG. 5.
Figure 8:
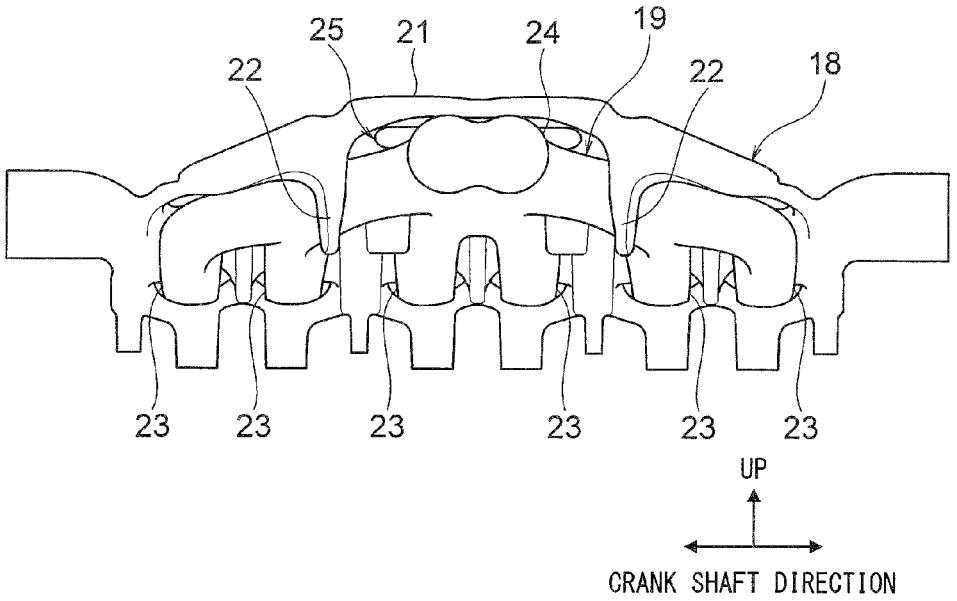
FIG. 8 is a front view of the core of FIG. 5.
Figure 9:
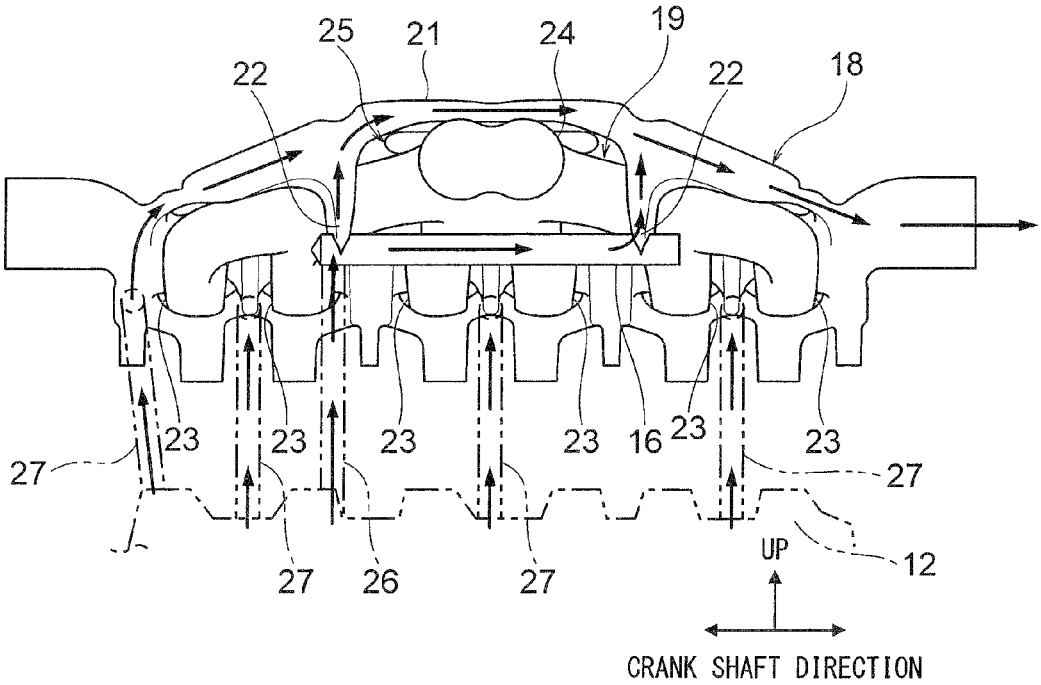
FIG. 9 is an explanatory diagram in which a lower side flow passage portion is added to the core of FIG. 8 by the cutting.
Figure 10:
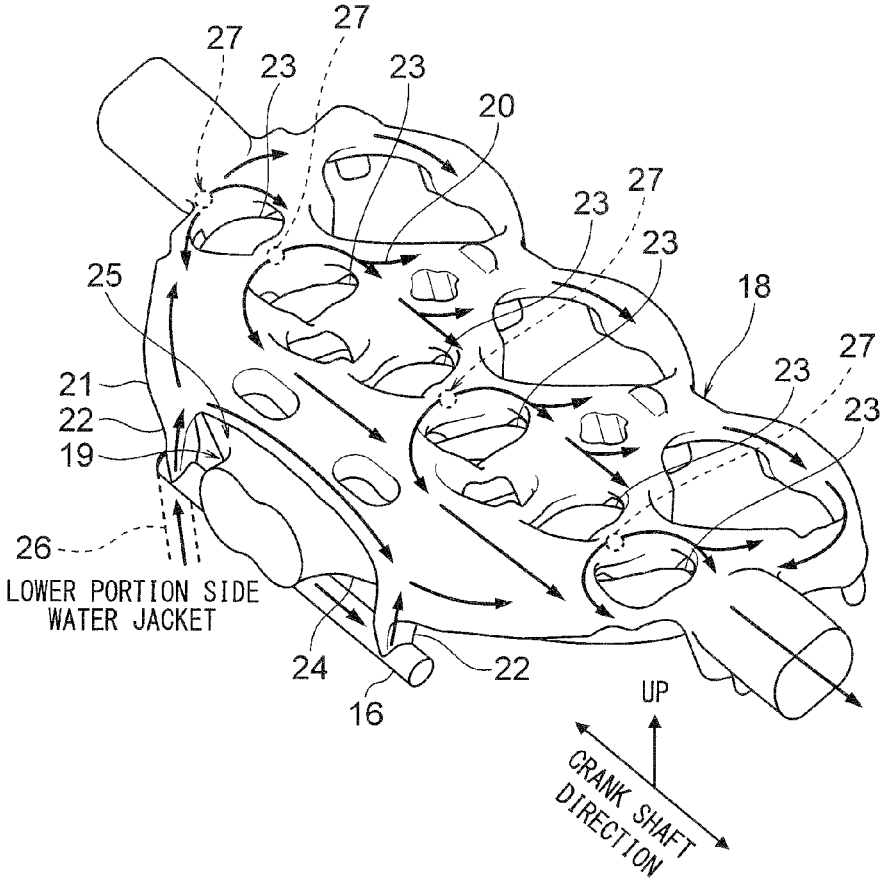
FIG. 10 is a perspective view of FIG. 9.

FIG. 5 is a plan view of a core to be used in the molding of the cylinder head of FIG. 1, FIG. 6 is a left side view of the core of FIG. 5, FIG. 7 is a bottom view of the core of FIG. 5, FIG. 8 is a front view of the core of FIG. 5, FIG. 9 is an explanatory diagram in which a lower side flow passage portion is added to the core of FIG. 8 by the cutting, and FIG. 10 is a perspective view of FIG. 9. The notation of left and right in the drawings is the notation according to the trigonometry, and not related to left and right of the motor vehicle. Consequently, in viewpoint of the engine main body, FIG. 6 is a diagram in which the core of FIG. 5 is viewed from the crank shaft direction.

As shown in FIG. 5 to FIG. 10, a core for upper portion side water jacket 18 is configured by being equipped with an upper portion side water jacket formation portion 20, an upper side flow passage portion formation portion 21, and extended flow passage portion formation portions 22. The upper portion side water jacket formation portion 20 forms the upper portion side water jacket 11 at a time of the molding. The upper side flow passage portion formation portion 21 is connected to the upper portion side water jacket formation portion 20. The upper side flow passage portion formation portion 21 forms the upper side flow passage portion 15 at a time of the molding. The extended flow passage portion formation portions 22 are connected to the upper side flow passage portion formation portion 21. The extended flow passage portion formation portions 22 form the extended flow passage portions 17 at a time of the molding. Also, a core for exhaust ports 19 is configured by being equipped with an exhaust port formation portion 23 and an exhaust collecting portion formation portion 24. The exhaust port formation portion 23 forms the exhaust ports 7 at a time of the molding. The exhaust collecting portion formation portion 24 forms the exhaust collecting portion 9 at a time of the molding. Note that the lower portion side water jacket 12 is formed at a time of the molding by a core for lower portion side water jacket not shown in the figure.

As shown in FIG. 5 to FIG. 8, the core for upper portion side water jacket 18 and the core for exhaust ports 19 are set in a mold for the molding in a manner of superposition in the engine up and down direction. Then, a material for cylinder head such as aluminum is cast in the mold to the surrounding of the core for upper portion side water jacket 18 and the core for exhaust ports 19. As a result, the upper portion side water jacket 11, the upper side flow passage portion 15, the extended flow passage portions 17, the exhaust ports 7, and the exhaust collecting portion 9 are formed at a time of the molding. As shown in FIG. 9 and FIG. 10, the lower side flow passage portion 16 is formed by drilling a wall of the cylinder head 1 with a drill. The drill has an axis line of the drill set in the crank shaft direction with respect to the cylinder head 1 after the molding. Then, the drilling with the drill for forming the lower side flow passage portion 16 is done such that a pair of the extended flow passage portions 17 are pierced through. As a result, the upper side flow passage portion 15, the extended flow passage portions 17 and the lower side flow passage portion 16 are set in communication.

The upper side flow passage portion 15 and the extended flow passage portions 17 are formed by the molding, and the lower side flow passage portion 16 is formed by the cutting. Consequently, it is possible to make the formation process of the upper side flow passage portion 15 and the extended flow passage portions 17 and the formation process of the lower side flow passage portion 16 to be separate processes. In other words, the upper side flow passage portion 15 and the extended flow passage portions 17 are formed by the molding first, and then the lower side flow passage portion 16 can be provided in the molded cylinder head 1 by the cutting. For this reason, at a time of combining the core for upper portion side water jacket 18 and the core for exhaust ports 19, it is possible to arrange the core for upper portion side water jacket 18 and the core for exhaust ports 19 in a manner of superposition in the engine up and down direction. Also, it is possible to insert the exhaust collecting portion formation portion 24 of the core for exhaust ports 19 from the engine lower side into a space 25 surrounded by the upper side flow passage portion formation portion 21 and the extended flow passage portion formation portions 22. Consequently, in the present embodiment, at a time of the molding, there is no need to set one core for water jacket among two cores for water jacket and the core for exhaust ports in the mold and then set the other core for water jacket by combining it with the core for exhaust ports in the mold after that, as in the conventional structure. By this, the time and effort required for the incorporation of the core for the exhaust port 7 are reduced, so that the productivity of the cylinder head is improved.

In this way, the upper side flow passage portion 15, the extended flow passage portions 17 and the lower side flow passage portion 16 are formed in the surrounding of the exhaust collecting portion 9, and the state of linking of these and the lower portion side water jacket 12 will be described in further detail using FIG. 3 to FIG. 6, FIG. 9 and FIG. 10. As mentioned above, FIG. 5, FIG. 6, FIG. 9 and FIG. 10 are those showing the state of setting of the core for upper portion side water jacket 18 and the core for exhaust ports 19. Note however that, it is very difficult to take out the coolant flow passages and show them in the figure, so that it is described by regarding these cores as the coolant flow passages and additionally describing the flows of the coolant by arrows. Also, in these figures, various types of the coolant communication passages including the lower portion side water jacket 12 are denoted by two dot chain lines for the purpose of the description.

As clearly shown in FIG. 3 to FIG. 5, the lower portion side water jacket 12 is opening on the joint surface 4. The joint surface 4 is formed at a surface where the cylinder head 1 is joined with the cylinder block 2. The lower portion side water jacket 12 is formed to be continuous in the arrangement direction of the cylinders. As shown in FIG. 5 and FIG. 9, the lower portion side water jacket 12 is connected with one side of a coolant communication passage 26. Another side of the coolant communication passage 26 is connected with the lower side flow passage portion 16. In this way, the lower portion side water jacket 12 and the lower side flow passage portion 16 are connected. The coolant communication passage 26 is formed by the cutting in a form of the drilling after the molding of the cylinder head 1, similarly as the lower side flow passage portion 16. Consequently, as shown in FIG. 3, FIG. 5, FIG. 6, FIG. 9 and FIG. 10, the coolant inside the lower portion side water jacket 12 sequentially flows through the coolant communication passage 26 to the lower side flow passage portion 16, from the lower side flow passage portion 16 to the extended flow passage portions 17, and from the extended flow passage portions 17 to the upper side flow passage portion 15. The coolant flowing inside the lower portion side water jacket 12 is supplied from a water jacket of the cylinder block 2. The coolant flowing in the water jacket of the cylinder block 2 is of a relatively low temperature. The coolant of a relatively low temperature is supplied from the coolant communication passage 26 to the lower side flow passage portion 16, from the lower side flow passage portion 16 to the extended flow passage portions 17, and from the extended flow passage portions 17 to the upper side flow passage portion 15, in a manner of surrounding the entire surrounding of the exhaust collecting portion 9. As a result, the cooling efficiency of the exhaust collecting portion 9 is good.

As described above, the upper portion side water jacket 11 and the upper side flow passage portion 15 are formed by the core for upper portion side water jacket 18 at a time of the molding. For this reason, the upper portion side water jacket 11 and the upper side flow passage portion 15 are in communication with each other. In the present embodiment, as shown in FIG. 4, FIG. 5 and FIG. 9, the lower portion side water jacket 12 and the upper portion side water jacket 11 are set in communication by an inter water jacket communication passage 27 between the adjacent exhaust ports 7 of each cylinder. This inter water jacket communication passage 27 is also formed on a further left side of the leftmost exhaust port 7 in these figures. Then, these inter water jacket communication passages 27 are also formed by the cutting in a form of the drilling after the molding of the cylinder head 1. The coolant of a relatively low temperature inside the lower portion side water jacket 12 flows through the inter water jacket communication passages 27, and is supplied to a section between the exhaust ports 7 of the upper portion side water jacket 11. The coolant of a relatively low temperature supplied to a section between the exhaust ports 7 positively cools the exhaust ports 7. The coolant of a relatively low temperature flowing inside the upper portion side water jacket 11 effectively cools the combustion chamber 5. A part of the coolant of a relatively low temperature flowing inside the upper portion side water jacket 11 is also supplied to the upper side flow passage portion 15, as shown in FIG. 10. As a result, it is also partly responsible for the cooling of the exhaust collecting portion 9.

As such, in the cylinder head of the present embodiment, the upper side flow passage portion 15 and the extended flow passage portions 17 into which the coolant flows are formed by the molding, and the lower side flow passage portion 16 into which the coolant flows similarly is formed by the cutting. In this way, it is possible to substantially surround the entire surrounding of the exhaust collecting portion 9 by these upper side flow passage portion 15, extended flow passage portions 17 and lower side flow passage portion 16. As a result the cooling efficiency of the exhaust collecting portion 9 is improved. Also, in the cylinder head of the present embodiment, because the lower side flow passage portion 16 is formed by the cutting, a core for forming the lower side flow passage portion 16 by the molding becomes unnecessary. For this reason, at a time of forming the cylinder head 1 by the molding, it becomes possible to set the core upper portion side water jacket 18 for forming the upper side flow passage portion 15 and the extended flow passage portions 17 and the core for exhaust ports 19 for forming the exhaust collecting portion 9 in the mold by superposing one on top of the other, without being obstructed by the lower side flow passage portion 16. Consequently, it is possible to prevent the breaking or the damaging of the cores, while the productivity is improved as the time and effort required for the incorporation of the cores are reduced.

Also, the upper side flow passage portion 15 and the extended flow passage portions 17 are integrally formed at a time of the molding by the core for upper portion side water jacket 18. In this way, it is possible to form the upper portion side water jacket 11, the upper side flow passage portion 15, the extended flow passage portions 17, the exhaust ports 7 and the exhaust collecting portion 9 at a time of the molding, by simply arranging the core for exhaust ports 19 including the exhaust collecting portion 9 and the core for upper portion side water jacket 18 in a manner of superposition in the engine up and down direction. In this way, the productivity of the cylinder head 1 is improved.

Also, the lower portion side water jacket 12 is formed on the joint surface 4 of the cylinder head 1. Into the lower portion side water jacket 12, the coolant flows from the cylinder block 2. The lower portion side water jacket 12 is formed to be extending in the arrangement direction of the cylinders. Then, a section between the lower portion side water jacket 12 and the lower side flow passage portion 16 is set in communication by the coolant communication passage 26. This coolant communication passage 26 is formed by the cutting. Consequently, the coolant of a relatively low temperature in the lower portion side water jacket 12 is supplied to the lower side flow passage portion 16 from the coolant communication passage 26, and further supplied to the upper side flow passage portion 15 from the extended flow passage portions 17. For this reason, in the surrounding of the exhaust collecting portion 9, the coolant of a low temperature flows without stagnation sequentially from the lower side flow passage portion 16 to the extended flow passage portions 17 and to the upper side flow passage portion 15, so that it is possible to improve the cooling efficiency of the exhaust collecting portion 9 even further. Also, because the coolant communication passage 26 is formed by the cutting, a core for forming the coolant communication passage 26 by the molding becomes unnecessary. For this reason, at a time of superposing the core for upper portion side water jacket 18 and the core for exhaust ports 19 in the engine up and down direction, it will not be obstructed by a core for coolant communication passage, so that the productivity of the cylinder head 1 is improved as much as that.

Also, the exhaust ports 7 and the exhaust collecting portion 9 are formed by the core for exhaust ports 19 at a time of the molding, and the lower portion side water jacket 12 on the engine lower side than the exhaust ports 7 and the exhaust collecting portion 9 is formed by the core for lower portion side water jacket at a time of the molding. In this way, by simply arranging the core for upper portion side water jacket 18, the core for exhaust ports 19, and the core for lower portion side water jacket in a manner of superposition, it is possible to form the upper portion side water jacket 11, the upper side flow passage portion 15, the extended flow passage portions 17, the exhaust ports 7, the exhaust collecting portion 9 and the lower portion side water jacket 12 at a time of the molding. In this way, the productivity of the cylinder head 1 is improved.

The invention claimed is:

1. A cylinder head comprising:

a joint surface;

a plurality of exhaust ports;

an exhaust collecting portion in fluid communication with the plurality of exhaust ports;

an upper side flow passage portion on an upper side of the exhaust collecting portion;

a lower side flow passage portion on a lower side of the exhaust collecting portion;

a pair of extended flow passage portions on both the upper side and the lower side of the exhaust collecting portion, the pair of extended flow passage portions interconnecting the upper side flow passage portion and the lower side flow passage portion and cooperating with the upper side flow passage portion and the lower side flow passage portion to surround the exhaust collecting portion;

a lower portion side water jacket formed inwardly from the joint surface;

an upper portion side water jacket in communication with the upper side flow passage portion;

a plurality of inter water jacket communication passages interconnecting the lower portion side water jacket and the upper portion side water jacket to permit coolant to flow from the lower portion side water jacket to the upper side flow passage portion; and a coolant communication passage interconnecting the lower portion side water jacket and the lower side flow passage portion to permit the coolant to flow from the lower side portion water jacket to the upper side flow passage portion through the lower side flow passage portion and the pair of extended flow passage portions, wherein the lower side flow passage portion is formed by cutting to interconnect the pair of extended flow passage portions, and the coolant communication passage is formed by cutting inwardly from the lower portion side water jacket to the lower side flow passage portion.

2. The cylinder head as recited in claim 1, wherein the upper side flow passage portion and the pair of extended flow passage portions are integrally molded using a core for the upper portion side water jacket, the core having an upper side flow passage portion formation portion and extended flow passage portion formation portions.

3. The cylinder head as recited in claim 2, wherein the lower portion side water jacket extends in a same direction as a plurality of cylinders which are arranged and formed in an associated cylinder block.

4. The cylinder head as recited in claim 3, wherein the exhaust ports and the exhaust collecting portion are formed by a core for exhaust ports at a time of the molding, and the lower portion side water jacket is formed by a core for the lower portion side water jacket at a time of the molding.

5. The cylinder head as recited in claim 1, wherein the lower portion side water jacket extends in a same direction as a plurality of cylinders which are arranged and formed in an associated cylinder block.

6. The cylinder head as recited in claim 5, wherein the exhaust ports and the exhaust collecting portion are formed by a core for exhaust ports by molding, and the lower portion side water jacket is formed by a core for the lower portion side water jacket at a time of the molding.

* * * * *